US007513805B2

(12) United States Patent
Shimizu

(10) Patent No.: US 7,513,805 B2
(45) Date of Patent: Apr. 7, 2009

(54) CONNECTOR WITH BORES DISPOSED TO AVOID CREATION OF CRACKS

(75) Inventor: Tooru Shimizu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/957,920

(22) Filed: Dec. 17, 2007

(65) Prior Publication Data

US 2008/0146094 A1 Jun. 19, 2008

(30) Foreign Application Priority Data

Dec. 19, 2006 (JP) ..... 2006-340983

(51) Int. Cl.
*H01R 13/514* (2006.01)

(52) U.S. Cl. ..... 439/752

(58) Field of Classification Search ..... 439/751, 439/752, 752.5

See application file for complete search history.

(56) References Cited

U.S. PATENT DOCUMENTS 4,356,532 A 10/1982 Donaher et al.
5,713,759 A 2/1998 Shinozaki
5,928,038 A 7/1999 Berg et al.
2003/0040224 A1 2/2003 Fujii et al.
2005/0245123 A1 11/2005 Shimizu

FOREIGN PATENT DOCUMENTS

JP 2000-173733 6/2000
JP 2006-032220 2/2006

*Primary Examiner*—Javaid Nasri
(74) *Attorney, Agent, or Firm*—Gerald E. Hespos; Anthony J. Casella

(57) ABSTRACT

A connector housing (20) includes a fitting recess (21A) and an intermediate wall (23) at the back of the fitting recess (21A). Press-in holes (28) extend through the intermediate wall (23) and receive tabs (12) of a joint terminal (10). Bored-portion forming regions (32M) are set above and below alignment regions for the press-in holes (28). However, the synthetic resin of the housing (20) extends continuously in portions (35) of the regions (32M) above and below intermediate positions between the press-in holes (28) adjacent in an alignment direction without providing any bored portion. The continuous material portions (35) prevent tensile forces from acting in the vertical direction between the two press-in holes (28) and prevent the formation of cracks in the resin material between the two press-in holes (28).

10 Claims, 8 Drawing Sheets

CONNECTOR WITH BORES DISPOSED TO AVOID CREATION OF CRACKS

BACKGROUND OF THE INVENTION

1. Field of the Invention

The invention relates to a connector of the type for holding terminal fittings pressed into a connector housing and to a method of forming it.

2. Description of the Related Art

Japanese Unexamined Patent Publication No. 2006-32220 and FIG. 8 herein disclose a joint connector. With reference to FIG. 8, the joint connector has a housing 1 made of synthetic resin and formed with oppositely facing fitting recesses 2 for receiving mating connectors. A thick partition wall 3 separates the fitting recesses 2 and is formed with a plurality of press-in holes 4 aligned at specified intervals in each of upper and lower rows. The joint connector of FIG. 8 also has terminal fittings with tabs at opposite ends. Middle parts of the terminal fittings between the tabs are pressed into the respective press-in holes 4 so that the tabs at the opposite ends project into the opposite fitting recesses 2. Bored portions 5 are formed to prevent surface sinks in areas of the partition wall 3 at sides of an alignment region of the press-in holes 4.

The intervals between terminal fittings have been narrowed to accommodate an increased number of required contacts. However, the narrower spacing has caused the resin between the press-in holes 4 to crack. The present inventors sought to determine the cause of the cracking.

As shown in an enlarged part of FIG. 8, the pressing of the terminal fittings into the press-in holes 4 causes compression forces x to act on the resin between the both press-in holes 4 from left and right sides. As a result, the resin tries to escape into the bored portions 5 and creates vertical tensile forces y in the partition wall 3. These forces are thought to be the cause of a crack k.

The invention was developed based on the above knowledge, and an object thereof is to prevent the formation of cracks between press-in portions for terminal fittings.

SUMMARY OF THE INVENTION

The invention relates to a connector with a housing made of a synthetic resin. The housing has a terminal holding portion formed with press-in holes through which terminal fittings are pressed. Bored portions are formed in regions of the terminal holding portion substantially parallel to an alignment region of the press-in holes. Continuous material portions are provided at positions in the bored-portion forming regions substantially corresponding to intermediate positions between the press-in holes that are adjacent in the alignment direction without providing any bored portion. The synthetic resin material of the housing is continuous through the continuous material portions.

Continuous material portions are arranged at least at one side of each intermediate position between adjacent press-in holes without providing any bored portion. Compression forces act on the resin between the two press-in holes when the terminal fittings are pressed into the press-in holes. However, little or no tensile force acts where the continuous material portion is present. As a result, the resin between the two press-in holes is prevented from cracking.

Continuous material portions preferably are provided at opposite sides of each intermediate position between the press-in holes. Thus, resin compressed between two press-in holes cannot escape towards either of the opposite sides. As a result, tensile force will not act and cracks will not form.

The terminal fittings preferably project substantially side by side from at least one lateral edge of a carrier. Thus, the terminal fittings can be pressed simultaneously into the corresponding press-in holes, and a connector assembling operation becomes easier.

Base ends of the terminal fittings connected with the carrier preferably are widened in a specified range to form press-in portions.

The bored portions preferably comprise at least one first bored portion in the form of a horizontally long groove having a vertical width larger than the thickness of the terminal fittings, a horizontal length of more than about 1.5 times the width of the terminal fittings and a depth less than about ⅔ of the thickness of the terminal holding portion.

The bored portions also preferably comprise at least one second bored portions opening in the back surface of the terminal holding portion, and preferably in a fitting recess provided therein. The second bored portions preferably are through holes having a vertical width slightly larger than about 1.5 times that of the first bored portions.

Mounting portions preferably are provided for joint terminals comprising the terminal fittings at one or more stages while being spaced apart by a specified distance.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A joint connector in accordance with first embodiment of the invention is described with reference to FIGS. 1 to 4. The joint connector includes a housing 20 made e.g. of synthetic resin. The housing 20 has a rectangular parallelepipedic outer shape. Front and rear fitting recesses 21A, 21B extend into opposite ends of the housing 20 with respect to a longitudinal direction LD and can receive mating female connectors (not shown).

A thick intermediate wall 23 is formed between the back surfaces of the fitting recesses 21A, 21B, and joint terminals 10 are pressed into the intermediate wall 23 at upper, middle and lower stages.

Figure 1:
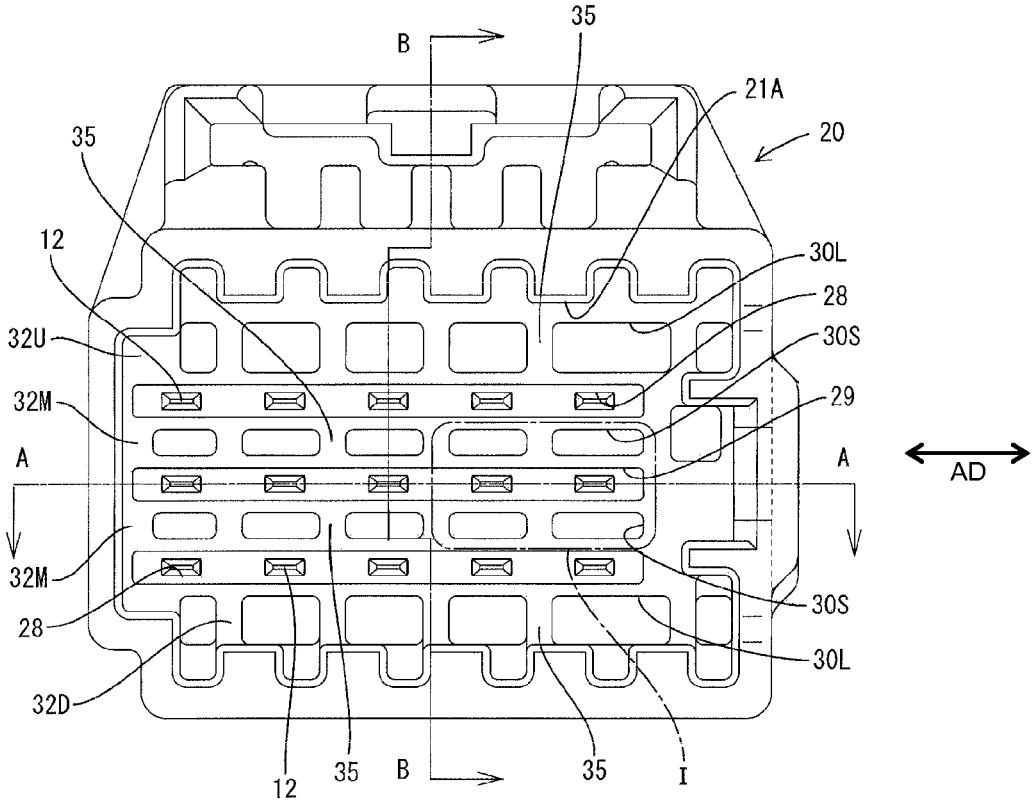
FIG. 1 is a front view of a connector according to a first embodiment of the invention.
Figure 2:
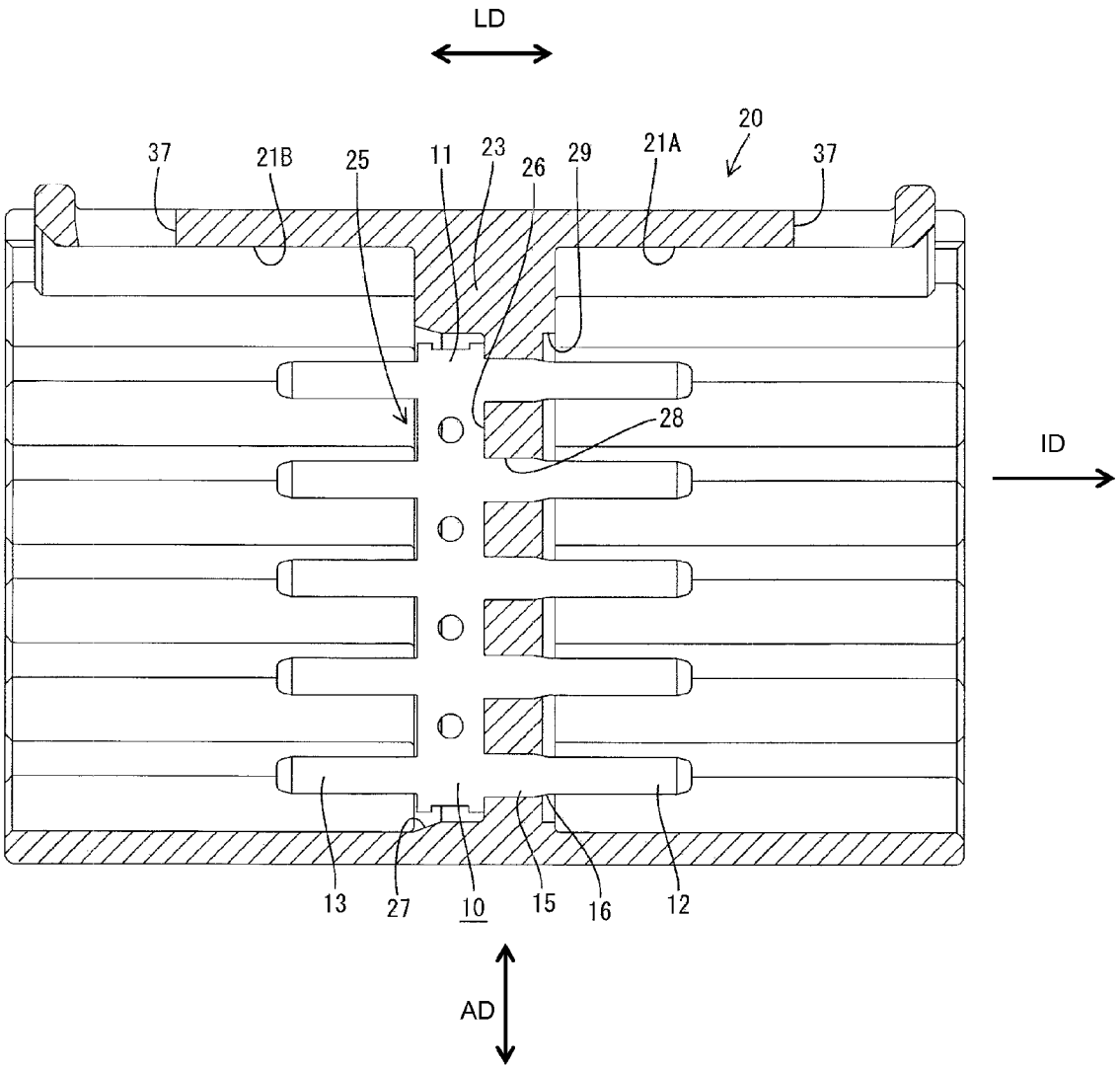
FIG. 2 is a section along A-A of FIG. 1.

As shown in FIG. 2, each joint terminal 10 has a long narrow carrier 11 with opposite front and rear edges. Front tabs 12 and rear tabs 13 project at substantially constant intervals and at substantially right angles from each of the opposite front and rear edges of the carrier 11. The front tabs 12 are longer than the rear tabs 13. Additionally, the base ends of the front tabs 12 are widened along a specified length range from the carrier 11 to form press-in portions 15. Slanted edges 16 are formed at the front ends of the press-in portions 15 to narrow the press-in portions 15 towards the front. Three joint terminals 10 having the above construction are prepared.

The intermediate wall 23 of the housing 20 is formed with three mounting portions 25 at spaced apart upper, middle and lower stages for receiving the three respective joint terminals 10. Each mounting portion 25 is formed so that the joint terminal 10 can be pressed therein from the side of the rear fitting recess 21B. More particularly, an insertion groove 26 is formed in the back surface of the rear fitting recess 21B over substantially the entire width for closely receiving the joint terminal 10, as shown in FIG. 2. The insertion groove 26 has a closed bottom located at an intermediate position of the intermediate wall 23 in thickness direction and has a depth capable of accommodating the carrier 11. At least one guide 27 is formed at the entrance of the insertion groove 26 and is widened toward the rear fitting recess 21B.

Press-in holes 28 are formed in the closed bottom of each insertion groove 26 at substantially the same intervals as the tabs 12. The press-in holes 28 extend from the respective insertion grooves 26 to the front fitting recess 21A and the respective tabs 12 of the joint terminal 10 can be pressed into the press-in holes 28. The press-in holes 28 have depths more than about ⅓ of the thickness of the intermediate wall 23, and preferably substantially half the thickness of the intermediate wall 23. Recessed grooves 29 are formed in the front fitting recess 21A to connect the exits of the press-in holes 28 at each stage.

The housing 20 is formed with bored portions 30 to prevent surface sinks. Small first bored portions 30S are formed in the back surface of the front fitting recess 21A at two intermediate regions 32M located between the alignment regions of the press-in holes 28 at the three stages. Larger second bored portions 30L are formed in an upper region 32U above and adjacent to the alignment region of the press-in holes 28 at the upper stage and in a lower region 32D below and adjacent to the alignment region of the press-in holes 28 at the lower stage.

Each intermediate region 32M has a height that is more than about twice, preferably about four times as large as the thickness of the tabs 12 and the upper and lower regions 32U and 32D have an even larger height.

Each first bored portion 30S is a horizontally wide groove having a vertical height larger than the thickness of the tabs 12, a horizontal width of more than about 1.5 times (preferably about twice) the width of the tabs 12 and a depth less than about ⅔ of (preferably slightly larger than half) the thickness of the intermediate wall 23.

The first bored portions 30S are aligned at substantially the same intervals as the press-in holes 28 in each intermediate region 32M with the transverse centers of the first bored portions 30S being aligned substantially with the centers of the press-in holes 28. In other words, the synthetic resin from which the housing 20 is unitarily molded forms continuous material portions 35 at positions between the adjacent first bored portions 30S and at the outer sides of the first bored portions 30S at the ends of the alignments.

Figure 3:
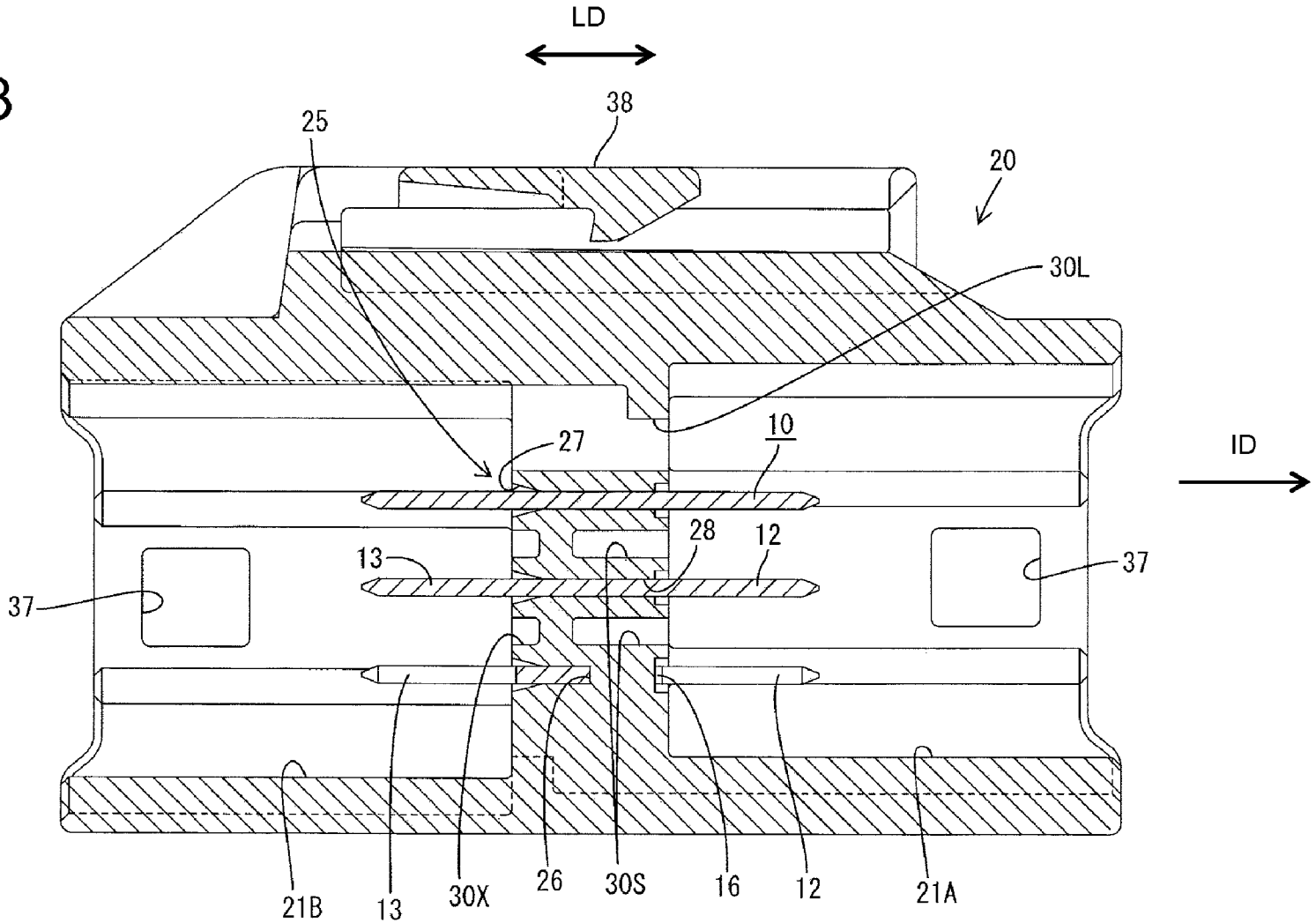
FIG. 3 is a section along B-B of FIG. 1.

As shown in FIG. 3, third bored portions 30X are formed in the intermediate wall 23 at the back surface of the rear fitting recess 21B and at positions rearward of the respective first bored portions 30S. The third bored portions 30X are substantially in the form of grooves having substantially the same front shape as the first bored portions 30S and a depth that is less than about half (preferably about one fourth) the depth of the first bored portions 30S.

The second bored portions 30L are through holes that open into the back surface of the rear fitting recess 21B that have vertical heights larger than about 1.5 times (preferably larger than about twice) the height of the first bored portions 30S. Additionally, the second bored portions 30L are not all the width.

The second bored portions 30L are spaced apart from each other and are at positions corresponding to the sides of the press-in holes 28 in the upper and lower regions 32U and 32D. The synthetic resin of the housing 20 extends unitarily through parts between the adjacent second bored portions 30L to define continuous material portions 35 that are located at the sides of the corresponding parts between the adjacent press-in holes 28.

In short, the rows of the press-in holes 28 are formed at three separate stages in the back surface of the front fitting recess 21A and the bored portions 30 are provided at opposite sides of the alignment regions of the press-in holes 28 at the respective stages. However, no bored portions are formed above or below the intermediate positions between the press-in holes 28 that are adjacent in the alignment direction AD at the respective stages. Rather, the synthetic resin of the housing 20 extends unitarily into and through these locations to define the continuous material portions 35.

Lock holes 37 are formed in side surfaces of the fitting recesses 21A, 21B and are used to lock the mating connectors fit into the fitting recesses 21A, 21B. Further, a socket 38 is provided on the upper surface of the housing 20 and is mounted to a bracket on a body, equipment or the like for mounting the housing 20.

The joint terminal 10 can be moved forwardly along the inserting direction ID into the rear fitting recess 21B with the longer front tabs 12 heading forward and then is inserted into the corresponding mounting portion 25. As the insertion proceeds, the longer front tabs 12 pass the insertion groove 26 and enter into the corresponding press-in holes 28. The press-in portions 15 at the base ends of the tabs 12 face the entrances of the press-in holes 28 towards the final stage of the insertion. The joint terminal 10 then is pushed farther, and the press-in portions 15 are pressed so that the slanted edges 16 of the press-in portions 15 bite in the opposite side walls of the press-in holes 28. The press-in operation is stopped when the carrier 11 is fit into the insertion groove 26 sufficiently to contact the back surface of the insertion groove 26.

In this way, the joint terminal 10 at each stage is held while the carrier 11 is embedded in the intermediate wall 23 at the side toward the rear fitting recess 21B and the longer front tabs 12 and the shorter rear tabs 13 project respectively into the front and rear fitting recesses 21A and 21B.

Figure 4:
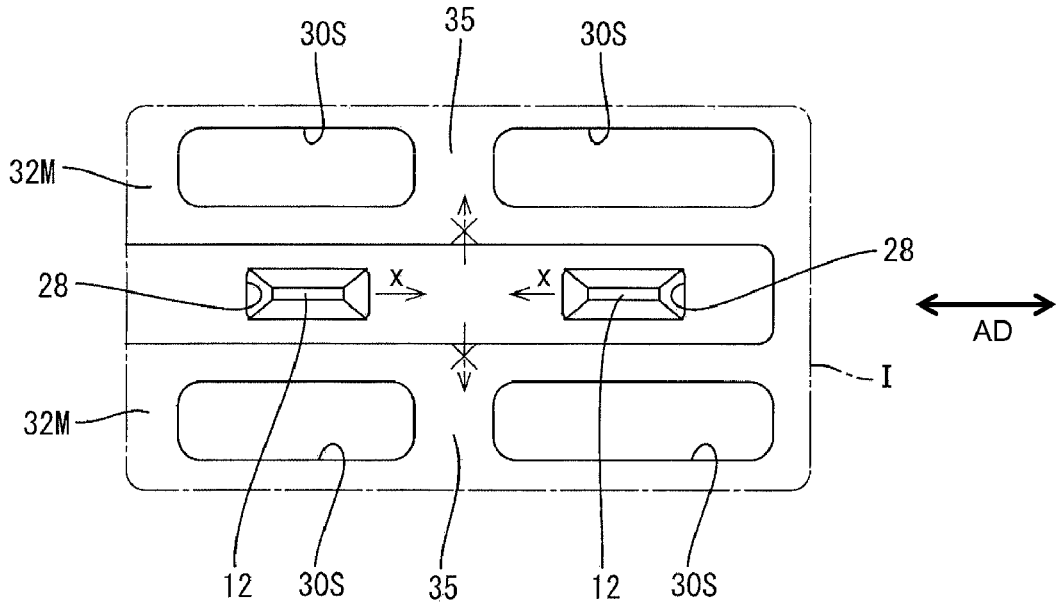
FIG. 4 is an enlarged view of a region I of FIG. 1.

Compression forces x act on the resin material between the transversely adjacent press-in holes 28, as shown in FIG. 4, when the respective tabs 12 of the joint terminal 10 are pressed substantially simultaneously into the corresponding press-in holes 28 at each stage. The synthetic resin material extends unitarily through areas above and below the intermediate positions between the two press-in holes 28 to define the continuous material portions 35, and there are no bored portions in the continuous material portions 35. Thus, unlike the case where bored portions 30 are provided, no tensile force acts in vertical direction. As a result, cracks do not form in the resin material between the two press-in holes 28.

Figure 5:
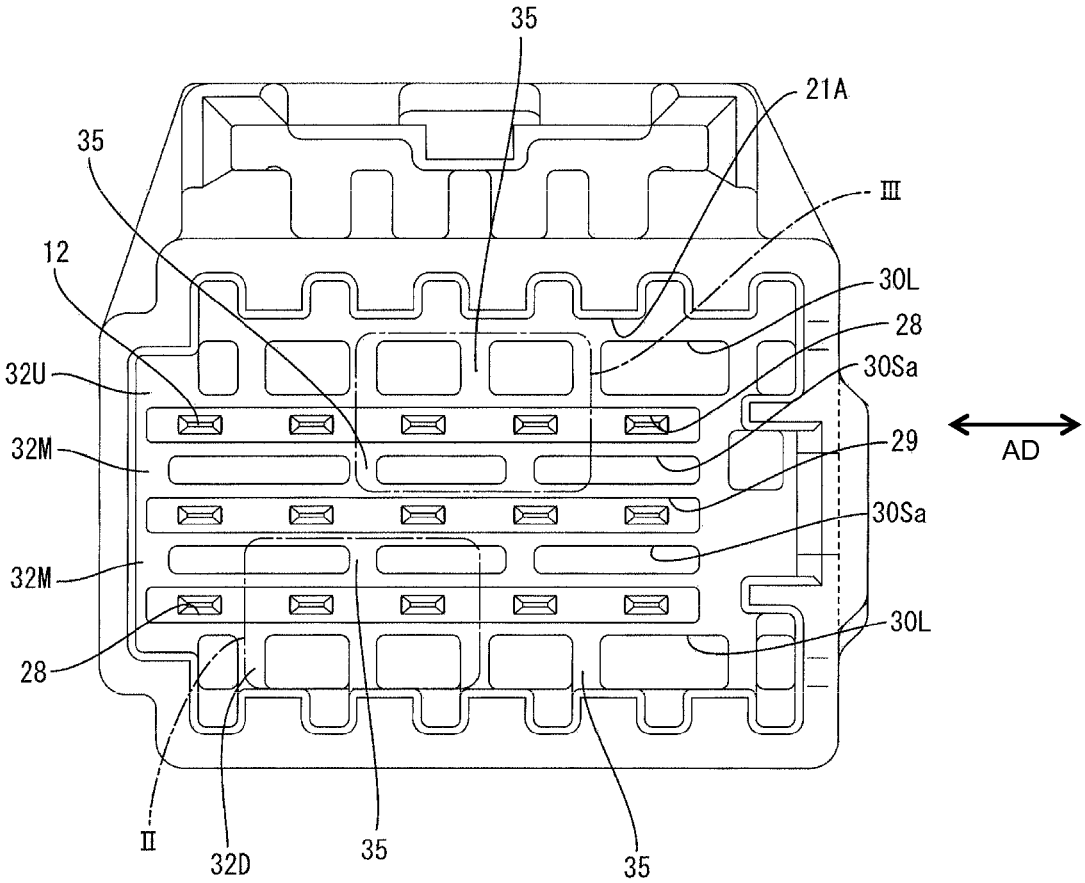
FIG. 5 is a front view of a connector of a second embodiment.
Figure 6:
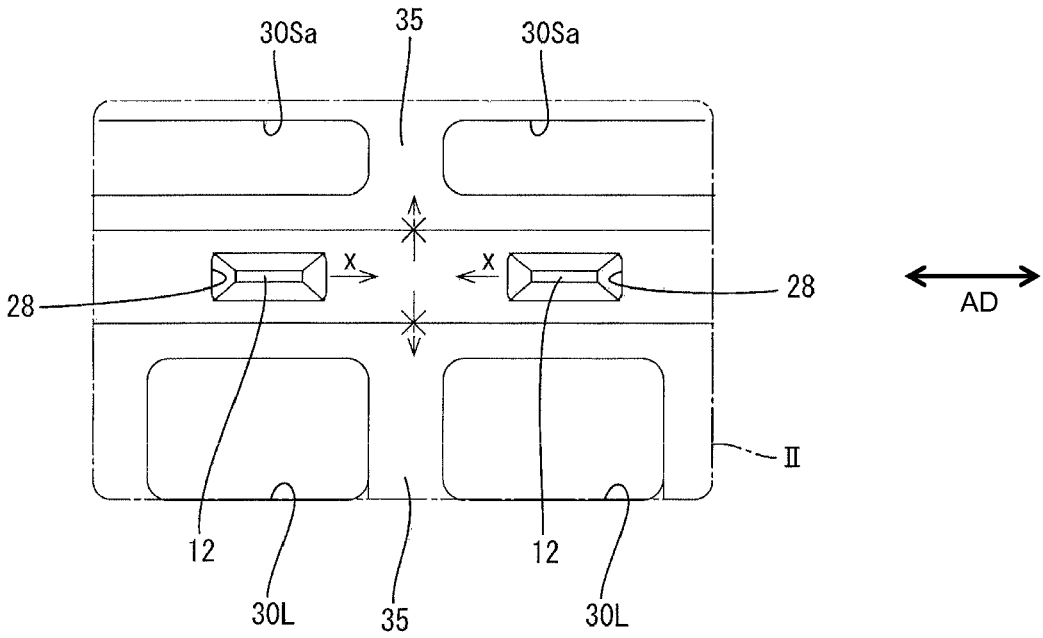
FIG. 6 is an enlarged view of a region II of FIG. 5.
Figure 7:
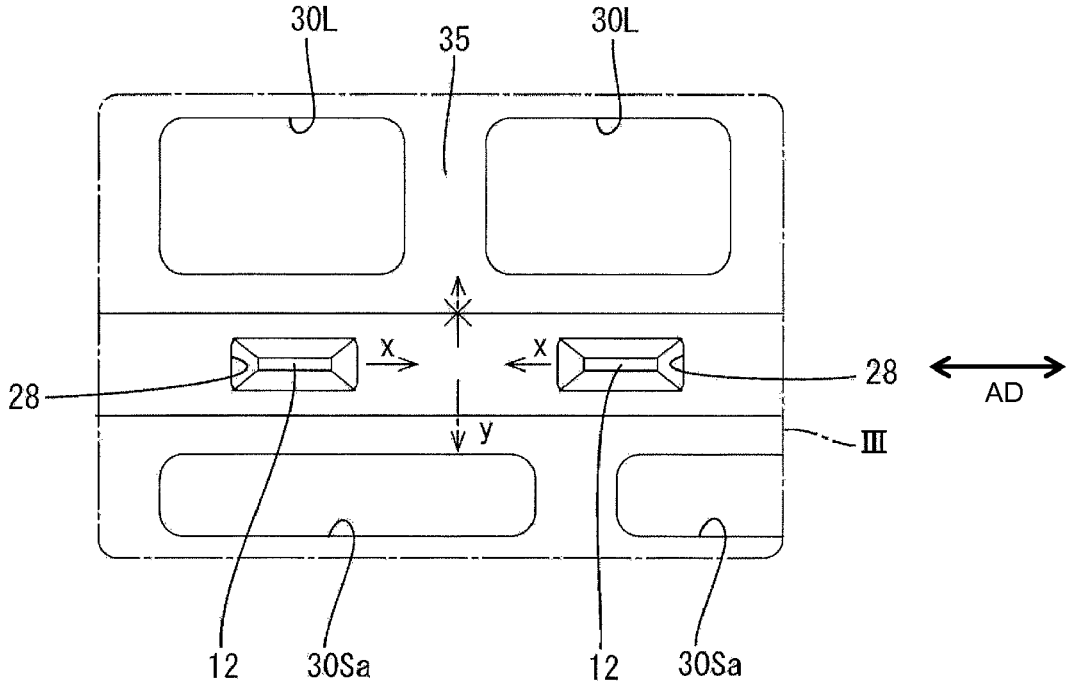
FIG. 7 is an enlarged view of a region III of FIG. 5.
Figure 8:
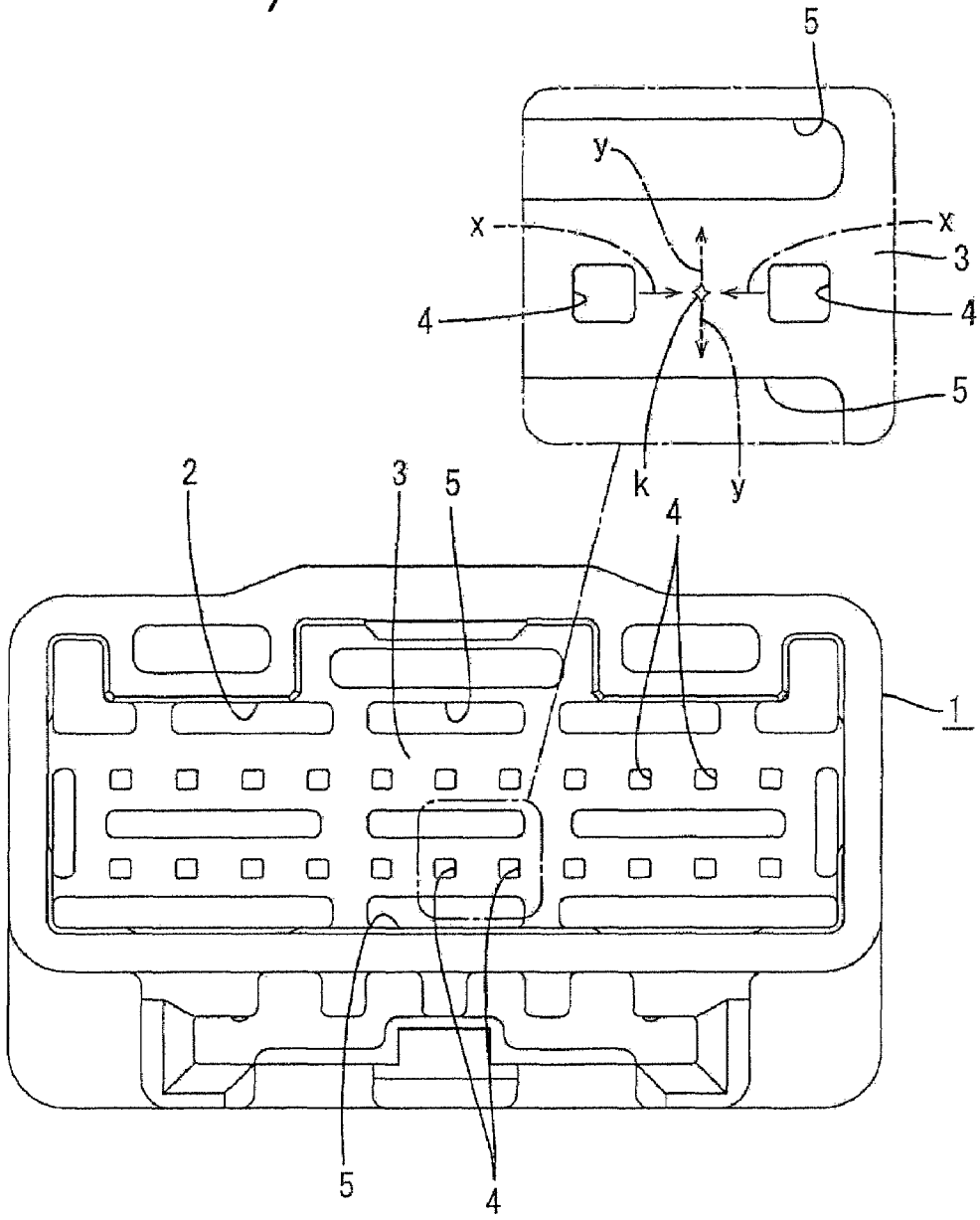
FIG. 8 (PRIOR ART)
FIG. 8 is a front view of a conventional connector housing.

A second embodiment of the invention is illustrated in FIGS. 5 to 7. The second embodiment differs from the first embodiment in the shape of first bored portions 30Sa formed in the two intermediate regions 32M. Specifically, the first bored portions 30Sa of the second embodiment differ from the first bored portions 30S of the first embodiment only in the transverse width, and only three first bored portions 30Sa are arranged at intervals in each intermediate region 32M as shown. The transverse widths of the first bored portions 30Sa are increased to enlarge molding pins for forming the first bored portions 30Sa for an increase in the strengths of the molding pins.

As a result of the above construction, the first bored portions 30Sa are present in some of parts adjacent to and above or below the intermediate positions between the adjacent press-in holes 28 in both intermediate regions 32M. For example, a formation region II is shown in FIGS. 5 and 6, and includes the second and third press-in holes 28 from the left at the lower stage. The synthetic resin in region II extends unitarily through areas above and below the intermediate position between the adjacent press-in holes 28 to define continuous material portions 35 that have no bored portion. Thus, as in the first embodiment and as shown in FIG. 6, no tensile force acts in the vertical direction even if compression forces x act on the resin between the transversely adjacent press-in holes 28 from the left and right sides as the tabs 12 are pressed in. As a result, cracks will not form in the resin material between the two press-in holes 28.

On the other hand, a formation region III shown in FIGS. 5 and 7 includes the third and fourth press-in holes 28 from the left. The synthetic resin extends unitarily into areas above the intermediate position between the left and right press-in holes 28 without providing any bored portion to define a continuous material portion 35. However, the first bored portion 30Sa is present below this intermediate position. Thus, even if compression forces x act on the resin between the transversely adjacent press-in holes 28 from left and right sides as the tabs 12 are pressed in, tensile force y acts only down. Therefore cracks are not made in the resin material between the two press-in holes 28.

Accordingly, the formation of cracks in the resin material is prevented effectively in the second embodiment as well.

The invention is not limited to the above described and illustrated embodiment. For example, the following embodiments are also embraced by the technical scope of the present invention as defined by the claims. Besides the following embodiments, various changes can be made without departing from the scope and gist of the present invention.

The numbers of the tabs in the alignment direction AD and the number of stages of the tabs shown in the foregoing embodiments are merely examples, and the invention is applicable to cases where the number of the aligned tabs and the number of the stages are set differently.

The invention is not only applicable to the joint connectors illustrated in the foregoing embodiments, but also is applicable to intermediate connectors for connecting two connectors, in which tab-shaped terminal fittings are pressed in a resin housing. In some of intermediate connectors, adjacent terminal fittings may be separated. Even in such a case, the problem of cracks similarly occurs, particularly, if aligned terminal fittings are pressed in simultaneously using a jig or the like. Therefore, the present invention can be an effective solution.

The invention is also applicable to circuit board connectors into which tab-shaped terminal fittings are pressed.

What is claimed is:

1. A connector comprising a housing made of synthetic resin, the housing having a terminal holding portion formed with a plurality of press-in holes spaced apart along an alignment direction and configured to have terminal fittings pressed therethrough, first and second arrays of bores formed in the terminal holding portion, the bores in each of the arrays being spaced apart in directions substantially parallel to the alignment direction of the press-in holes the first and second arrays of bores being offset from the press-in holes in transverse directions that are transverse to the alignment direction of the press-in hole, the bores in each of the arrays being disposed so that each of the press-in holes is disposed between one of the bores in the first array and one of the bores in the second array, and continuous material portions through which the synthetic resin of the housing is continuous being defined between the press-in holes that are adjacent in the alignment direction, the continuous material portions extending continuously in the transverse directions into spaces between the bores in the first array that are adjacent in the alignment direction and into spaces between the bores in the second array that are adjacent in the alignment direction.

2. The connector of claim 1, wherein the respective terminal fittings project substantially side by side from at least one lateral edge of a carrier.

3. The connector of claim 2, wherein base ends of the terminal fittings connected with the carrier are widened in a specified range to form press-in portions.

4. The connector of claim 1, wherein each of the bores has a cross-sectional dimension measured in the transverse directions that is larger than a thickness of the terminal fittings measured in the transverse directions, each of the bores further having a cross-sectional dimension measured parallel to the alignment direction of more than about 1.5 times a width of the terminal fittings measured parallel to the alignment direction.

5. The connector of claim 4, wherein a plurality of bores extend entirely through the terminal holding portion.

6. The connector of claim 5, wherein the bores that extend entirely through the terminal holding portion have a cross-sectional dimension measured in the transverse directions that is slightly larger than about 1.5 times that of the bores that do not extend entirely through the terminal holding portion.

7. The connector of claim 1, wherein the press-in holes are arranged at plural stages spaced apart by a specified distance in the transverse directions, the terminal holding portion further being formed with at least a third array of bores disposed so that each of the stages of the press-in holes for the terminal fitting is disposed between two of the arrays of bores.

8. A connector comprising a housing made of a synthetic resin, the housing having opposite front and rear ends and a terminal holding portion between the front and rear ends, a plurality of press-in holes formed through the terminal holding portion, and being dimensioned for press-fitting terminal fittings therein, the press-in holes being arranged in a plurality of stages that are spaced apart in a height direction, the press-in holes in each of the stages being spaced apart from one another in an alignment direction that is transverse to the height direction, each press-in hole being aligned in the height direction with at least one of the pressing holes in an adjacent one of the stages, a plurality of arrays of bores formed in the terminal holding portion so that each array of bores is offset in the height direction from each of the stages of press-in holes, the bores in each of the arrays being spaced from one another in the alignment direction and being aligned respectively with the press-in holes in the height direction, continuous material portions extending in the height direction between the press-in holes and the bores that are aligned in the height direction and defining portions of the terminal holding portion through which the synthetic resin of the housing is continuous.

9. The connector of claim 8, wherein each of the bores defines a cross-sectional dimension in the height direction that exceeds cross-sectional dimensions of the press-in holes measured in the height direction.

10. The connector of claim 8, wherein each of the bores defines a cross-sectional dimension in the alignment direction that exceeds cross-sectional dimensions of the press-in holes measured in the alignment direction.

* * * * *